US008746166B2

(12) United States Patent
Bauvin et al.

(10) Patent No.: US 8,746,166 B2
(45) Date of Patent: Jun. 10, 2014

(54) METHOD AND MACHINE FOR COATING A SURFACE OF A HOLLOW BODY MADE OF GLASS

(75) Inventors: Antoine Emile André Marie Bauvin, Quesnoy le Montant (FR); Nicolas Pierre François Devaux, Ault (FR); Christophe Wagner, Neuville les Dieppe (FR)

(73) Assignee: SGD S.A., Puteaux (FR)

( * ) Notice: Subject to any disclaimer, the term of this patent is extended or adjusted under 35 U.S.C. 154(b) by 0 days.

(21) Appl. No.: 13/252,819

(22) Filed: Oct. 4, 2011

(65) Prior Publication Data

US 2012/0082788 A1 Apr. 5, 2012

(30) Foreign Application Priority Data

Oct. 5, 2010 (FR) ..... 10 58081

(51) Int. Cl.
*B05C 7/00* (2006.01)
*B05D 7/22* (2006.01)

(52) U.S. Cl.
USPC ..... 118/318; 118/321; 427/234

(58) Field of Classification Search
USPC ..... 427/230–239; 118/300, 317, 318, 320, 118/321, 323; 239/1, 255.1, 227
See application file for complete search history.

(56) References Cited

U.S. PATENT DOCUMENTS

| | | | | |
|---|---|---|---|---|
| 1,816,903 | A | 8/1931 | Hageman et al. | |
| 1,865,436 | A * | 7/1932 | Ferguson | 118/58 |
| 3,915,114 | A | 10/1975 | Pelton | |
| 2008/0001005 | A1 | 1/2008 | Weaver et al. | |

FOREIGN PATENT DOCUMENTS

| | | | |
|---|---|---|---|
| FR | 2138510 | A1 | 1/1973 |
| WO | WO 98/14384 | A1 | 4/1998 |

OTHER PUBLICATIONS

Preliminary Search Report issued by the French National Industrial Property Institute (INPI) on May 11, 2011 in connection with French Patent Application No. FR 1058081.

* cited by examiner

*Primary Examiner* — William Phillip Fletcher, III
(74) *Attorney, Agent, or Firm* — John P. White; Cooper & Dunham LLP

(57) ABSTRACT

The invention relates to a method of coating a surface (2) of a hollow body (1), said method comprising:

a step of positioning said hollow body (1) on a support (7) designed to receive said hollow body (1); and a step of spraying at least one coating material onto said surface (2) of said hollow body (1) by means of a spray device (9), relative movement being imparted to said support (7) and to said spray device (9);

said coating method being characterized in that said relative movement takes place at a velocity that varies as a function of the distance (d) between the spray device (9) and said surface (2). Coating machines.

24 Claims, 2 Drawing Sheets

METHOD AND MACHINE FOR COATING A SURFACE OF A HOLLOW BODY MADE OF GLASS

The present invention relates to the general field of tools for coating a surface of an article, i.e. for covering such a surface with a coating or with a lining, and the present invention relates in particular to the field of coating machines operating by spraying coating materials, e.g. decorative materials, onto the surface of an article.

The present invention relates more particularly to the technical field of methods and machines for coating the surfaces of hollow bodies, in particular bottles, such as, for example, glass bottles designed to contain pharmaceuticals or cosmetics, such as perfume.

The present invention relates more precisely to a method of coating a surface of a hollow body, said method comprising:

- a step of positioning said hollow body on a support designed to receive said hollow body; and
- a step of spraying at least one coating material onto said surface of said hollow body by means of a spray device, relative movement being imparted to said support and to said spray device.

The present invention also relates to a coating machine for coating a surface of an article, said coating machine including a support designed to receive said article and a spray device designed to spray at least one coating material onto said surface of said article, said support and said spray device being designed to have relative movement imparted to them.

It is known that it is possible to decorate the surfaces of articles, in particular of hollow bodies designed to contain contents such as foodstuffs, cosmetics, or pharmaceuticals. Such decoration, which is usually performed for procuring aesthetically pleasing appearance and/or for providing information, consists in decorating the outside face and/or the inside face of the hollow body, e.g. a bottle for cosmetics such as perfumes.

To this end, decoration machines are known, in particular, that implement fast and effective techniques for screen-printing or spraying a decoration onto the outside surface of a bottle, in particular when it is a perfume bottle made of glass.

For decorating the inside surfaces of glass bottles, it is possible to use a spraying technique that consists mainly in spraying a decorative material on the inside surface of the bottle, in particular by means of a nozzle. In which case, the decoration machine has a bottle-holder spindle on which the bottle to be decorated is deposited. In general, the nozzle, carried by a rod at its bottom end, is then lowered into the bottle and it sprays the decorative material while the spindle is being caused to rotate. The association of a rotary movement of the bottle and of a downward movement of the nozzle makes it possible to cover the inside surface of the bottle at least partially with decorative material.

Thus, in that type of decoration machine, two main operating options can be implemented in order to decorate the inside surface of the bottle optimally:

- Option 1: the bottle is placed on the spindle, which is caused to rotate about a substantially vertical axis of rotation, in order to cause the bottle to rotate. While the bottle is rotating, the nozzle, while being caused to move downwards into the bottle, sprays the decorative material.
- Option 2: the bottle is placed on the spindle, which is held stationary, while the nozzle moves vertically down into the bottle and is caused to rotate.

Those two options, used as alternatives depending on the bottle decoration needs, make it possible to distribute the decorative material over the inside surface of the bottle.

Coating machines are also known for coating a bottle, and in particular for coating, the inside surface of a pharmaceutical bottle, e.g. in order to make the inside surface compatible with the pharmaceutical contained in the bottle and/or in order to improve conservation of the pharmaceutical. Such coating machines generally operate quite similarly to the above-mentioned decoration machine, the material sprayed onto the inside surface not, however, necessarily being a decorative material, but rather being a functional coating.

However, the above-mentioned decoration machine implementing at least one of these options suffers from certain drawbacks.

That machine makes it possible to achieve a decoration with adequate distribution of the decorative material over the inside surface of the bottle, provided that said bottle has a simple shape, e.g. provided that it is cylindrical or square.

Whenever the shape of the bottle is more complex, e.g. for bottles of rectangular, oval, or some other shape, the above-mentioned decoration machine does not always make it possible to achieve homogeneous distribution of the decorative material, i.e. it does not always make it possible to obtain a layer of decorative material that is of constant thickness and that is evenly distributed.

To mitigate that problem, it is known that the spray flow-rate of the decorative material can be increased when the bottle is of complex shape, and in particular when an opaque decorative material is deposited.

However, that solution does not necessarily guarantee homogeneous distribution of the material and leads to high consumption of decorative material. Such consumption has a non-negligible economic impact on manufacture of such bottles.

In addition, the increase in the quantity of material to be applied gives rise to difficulties for applying the decorative material in the form of a homogeneous fine layer, in particular for translucent contents.

It should also be noted that the heterogeneity of the sprayed layer of decorative material can cause dark demarcation lines to appear on the surface of the bottle. Such lines are visible to the consumer and are particularly unaesthetic.

Such difficulties are naturally transposable to the above-mentioned coating machine for coating pharmaceutical bottles.

Objects assigned to the invention are therefore to remedy the problems described above and to propose a novel method of coating a hollow body that enables a coating material to be distributed optimally and homogeneously over the surface of the hollow body, regardless of the size and shape of said hollow body.

Another object of the invention is to propose a novel method of coating a hollow body that is particularly practical and quick to implement regardless of the shape and size of said hollow body.

Another object of the invention is to propose a novel method of coating a hollow body that ensures effective and precision distribution of the coating material.

Another object of the invention is to propose a novel method of coating a hollow body that makes it possible to optimize the quantity of coating material to be used, while also guaranteeing achievement of a layer of coating material that is evenly distributed.

Another object of the invention is to propose a novel method of coating a hollow body that makes it possible in simple and optimum manner to coat a glass bottle with a coating or lining that is visually uniform.

Another object of the invention is to propose a novel coating machine for coating an article that makes it possible for a coating material to be distributed optimally and homogeneously over the surface of the article, regardless of the size and shape of the article.

Another object of the invention is to propose a novel coating machine for coating an article that implements devices that are simple, quick, and practical to use.

Another object of the invention is to propose a novel coating machine for coating an article that ensures that the coating material is of constant and even thickness by means of tools that are simple to use.

The objects assigned to the invention are achieved by means of a method of coating a surface of a hollow body made of glass and constituting a container designed to receive contents of the food type, of the pharmaceutical type and/or of the cosmetic type such as perfume, said method comprising:

- a step of positioning said hollow body on a support designed to receive said hollow body; and
- a step of spraying at least one coating material onto said surface of said hollow body by means of a spray device, relative movement being imparted to said support and to said spray device;

said coating method being characterized in that said relative movement includes rotation of said support taking place at a velocity that varies as a function of the distance between the spray device and said surface.

The objects assigned to the invention are also achieved by means of a coating machine for coating a surface of a hollow body made of glass and constituting a container designed to receive contents of the food type, of the pharmaceutical type and/or of the cosmetic type such as perfume, said coating machine including a support designed to receive said hollow body and a spray device designed to spray at least one coating material onto said surface of said hollow body, said support and said spray device being designed to have relative movement imparted to them, said coating machine being characterized in that it is designed so that said relative movement includes rotation of said support taking place at a velocity that varies as a function of the distance between said spray device and said surface, while the spray device is spraying said at least one coating material.

Other objects and advantages of the invention appear more clearly on reading the following description, and on examining the accompanying drawings, which are given merely by way of non-limiting illustration, and in which.

Figure 4:
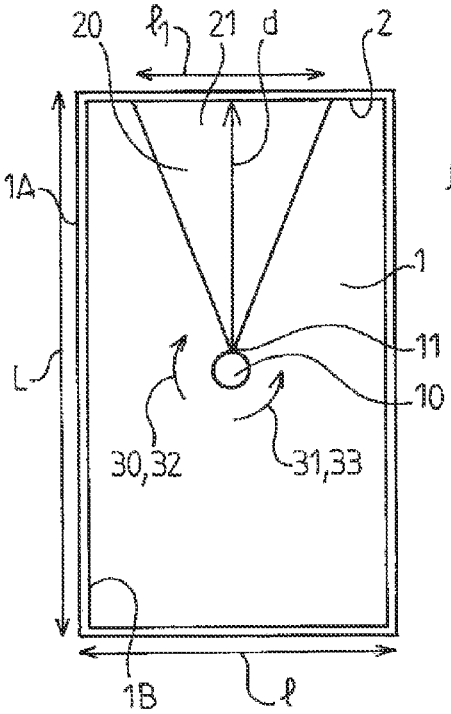
Figure 5:
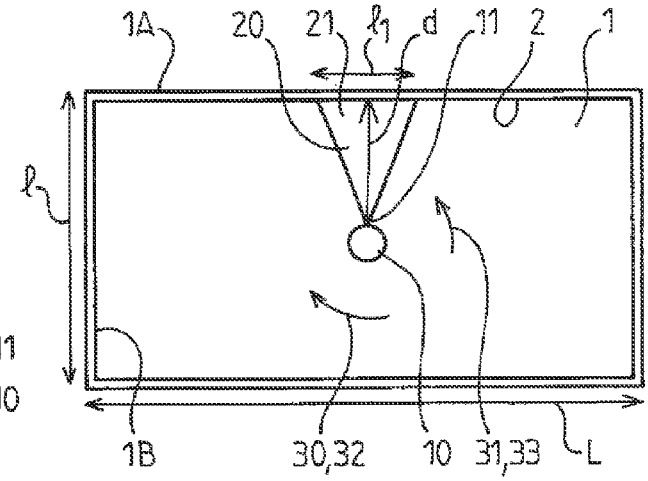

FIG. 4 is a diagrammatic section view from above, showing a narrow spray beam of a spray device of the invention in a bottle that is of substantially rectangular section, while the narrow spray beam is moving over the width of the bottle; and FIG. 5 is a diagrammatic section view from above, showing a narrow spray beam of a spray device of the invention in a bottle that is of substantially rectangular section, while the narrow spray beam is moving over the length of the bottle.

The invention relates firstly to a method of coating a surface 2 of a hollow body 1, i.e. to a method designed to cover, coat or line the surface 2. The surface 2 is preferably a surface that is not circularly symmetrical. The hollow body 1 preferably constitutes a container designed to receive solid, fluid, or semi-liquid contents, e.g. contents of the food type, of the pharmaceutical type, and/or of the cosmetic type, and in particular an alcoholic liquid such as a body perfume. The hollow body 1 thus advantageously forms a receptacle, and preferably a receptacle that can be held in the hand, such as, for example, a bottle, a flask, or a jar. Preferably, the method is designed to be implemented in a mass-production context, in which series of coated hollow bodies 1 are to be produced industrially.

The hollow body 1 of the invention extends along a main extension axis (XX') (cf. FIG. 1) between a bottom 3 and an opening 4 via which the contents are fed into the hollow body 1, which body also defines an internal cavity 5 in which said contents are received and retained. The main extension axis (XX') is preferably a central axis, defined, for example, by the intersection of two orthogonal planes of symmetry of the surface 2. The hollow body 1 is also defined by an outside wall 1A and by an inside wall 1B, which inside wall is designed to come into contact with the contents. The hollow body advantageously has a neck 6, i.e. a narrow passage making it possible to put the inside of the hollow body 1 into communication with the outside, into or onto which neck a closure device (not shown) is inserted or fastened, in order to keep said contents inside the hollow body 1.

In preferred manner, the surface 2 of the hollow body 1 constitutes at least a fraction of the inside wall 1B and/or of the outside wall 1A of said hollow body 1. In other words, the method of the invention is adapted to make it possible to coat, and preferably to decorate, all or some portion of the inside wall 1B and/or of the outside wall 1A of said hollow body 1.

Figure 1:
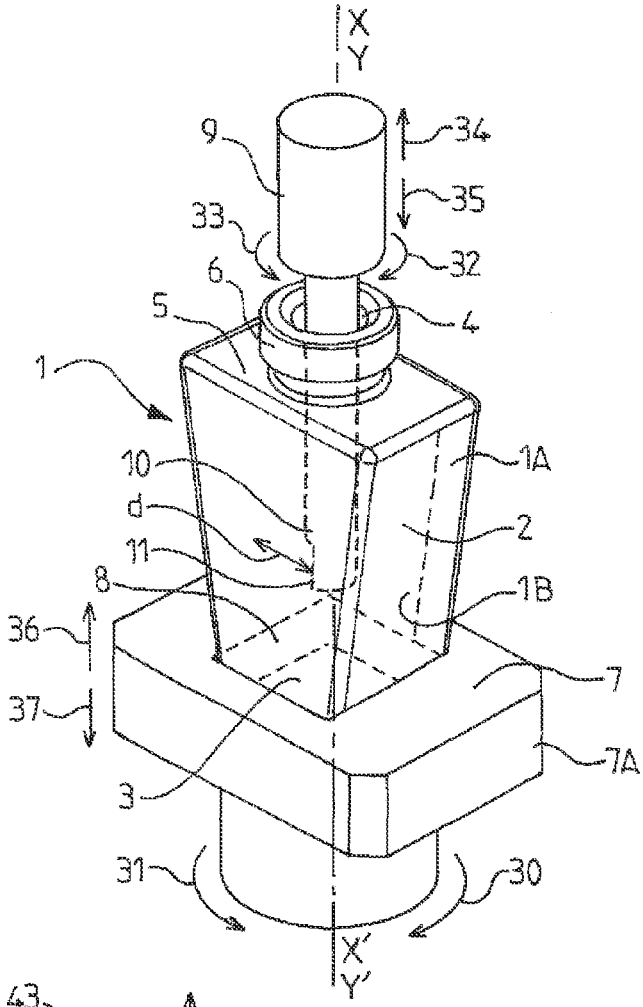
FIG. 1 is a diagrammatic perspective view of a portion of a coating machine of the invention for coating a hollow body, showing the hollow body positioned on a support and receiving a spray device in accordance with the present invention, which hollow body is a bottle designed to receive liquid body perfume in this example.

In a particularly advantageous implementation, said hollow body 1 is a bottle 1 as shown in FIG. 1, designed to contain a pharmaceutical, a care cosmetic, or a perfume. Preferably, said hollow body 1 is a glass bottle, e.g. designed to contain a liquid or semi-liquid cosmetic, and preferably a perfumed alcoholic liquid. In preferred manner, the bottle 1 is made mostly of glass, in particular of a soda-lime glass or of a borosilicate glass, the surface 2 to be coated preferably being made of glass. In a preferred implementation, the bottle 1 is made of a glass that is conventionally encountered in the cosmetics, food, or pharmaceuticals field, in particular a lead-free glass.

This coating method is advantageously designed to make it possible to functionally coat the inside wall 1B of said hollow body, in a manner such as to make it compatible with the contents contained in said hollow body 1 and/or in a manner such as to improve the conservation of said contents, in particular when the contents are pharmaceuticals, such as medicinal drugs, for example.

In a particularly preferred implementation, the coating method of the invention constitutes a method of decorating said surface 2 with at least one decoration material, and preferably a method of decorating a glass bottle 1, e.g. in the field of perfume bottles 1. It is preferably a decoration method that is designed to improve the aesthetic appearance of said hollow body 1, in particular by covering the surface 2 with a decoration, with decorative marking, with ornamentation, or with any other decoration element.

Thus, in the description below, for reasons of clarity and of concision, a preferred method of decorating a perfume bottle 1 made of glass is described merely by way of non-limiting illustration.

The coating method of the invention is preferably part of a full method of manufacturing a bottle 1, and it therefore includes a first step of supplying or of manufacturing the bottle 1, which is advantageously made of glass, i.e. a bottle procurement step 1.

Subsequently to the procurement step, the coating method, which is preferably a decoration method in this example, also includes a positioning step for positioning said hollow body 1 on a support 7 that is designed to receive said hollow body 1. As shown in FIG. 1, the support 7 is provided with an indentation 8 into which the bottle 1 is inserted via its bottom 3, so that the bottle 1 extends, for example, substantially vertically in its operating position. It is, however, quite possible for the indentation 8 to hold said bottle 1 in a substantially horizontal position.

Advantageously, the support 7 includes a fitting 7A or a bottle-holder spindle 7A designed to hold said bottle 1 while said bottle is being decorated.

Subsequently to the positioning step, the method also includes, a spraying step for spraying at least one coating material onto said surface 2 of said hollow body 1 by means of a spray device 9. During the spraying step, said spray device 9 sprays or propels said material, which is preferably a decoration material that is advantageously in atomized, liquid, or semi-liquid form, onto said surface 2 to be covered or to be decorated. Preferably, said coating material is in a finely divided form, e.g. in the form of droplets that are propelled, sprayed, or atomized, preferably in the form of a spray mist, onto said surface 2.

Preferably, the decoration material is sprayed by the spray device 9 directly onto the preferably glass surface 2 in the form of a uniform layer that substantially covers the entire surface 2 to be decorated or to be coated. The spraying thus advantageously takes place directly onto the glass inside wall 1A of said bottle 1, in such a manner as to obtain a layer of material that is evenly distributed and that is of substantially constant thickness over the entire surface 2. Advantageously, the coating material, which is, in particular, a decoration material, is compatible with the contents designed to be contained in said bottle 1, said layer being designed to come directly into contact with the contents, which are, for example of the cosmetic type or of the pharmaceutical type.

In an advantageous implementation, the spray device 9 includes a nozzle 10 provided with a spray orifice 11 via which the decoration material is sprayed, e.g. in the form of a mist of atomized fine droplets.

During the spraying step, said coating material is sprayed, from the nozzle 10, preferably in the form of a spray beam 20 that is substantially conical in shape, and preferably in the shape of a cone that diverges going from the nozzle 10 towards the surface 2. Alternatively, the spray beam 20 may have any other shape, be it geometrical or otherwise.

As shown in FIGS. 4 and 5, the spray beam 20 advantageously forms a narrow spray beam 21, that is of substantially triangular and two-dimensional shape (as seen from above), and that is of width $l_1$ that is not constant, in particular when the bottle 1 is, for example, of rectangular section. Alternatively, it is naturally quite possible, without going beyond the ambit of the present invention, for the spray beam 20 and therefore for the corresponding narrow spray beam 21 to be of shape that is different, e.g. of cylindrical shape, in the shape of a rectangular block, or of any other shape, be it geometrical or otherwise.

This spraying step thus consists, for example, in atomizing the coating material, which is, for example, a decoration material, onto the inside wall 1B or onto the outside wall 1A of the bottle 1 from the nozzle 10 and in the form of a spray beam 20. Preferably, said at least one coating material is chosen from among at least one of the following coating materials: lacquer, sol-gel solution, metal solution, solutions constituted by organometallic resins, varnish, and paint.

In a preferred implementation, the method of the invention thus constitutes a decoration method for decorating the inside wall 1B of a perfume bottle 1 made of glass, by means of a metallic composition or of a composition obtained by a sol-gel method. In other words, the coating is advantageously a decorative coating, e.g. for aesthetic purposes, in particular in the cosmetics field.

Alternatively, and without going beyond the ambit of the present invention, as mentioned above, it is quite possible for the coating to be a functional coating, i.e. of a technical type, and designed to modify the state of the surface 2, without necessarily having any particular aesthetic objective. In which case, the coating makes it possible, for example, to increase the compatibility of the wall 1A, 1B with the contents contained in the hollow body 1, in particular in the pharmaceuticals field.

During the spraying step, relative movement is imparted to said support 7 and to said spray device 9, i.e. they are caused to move relative to each other. It is possible to make provision for only one of them to move, i.e. for only the support 7 or for only the spray device 9 to move, or indeed to make provision for both said support 7 and said spray device 9 to be caused to move simultaneously. The relative movement is constituted by movement in rotation and/or in translation of said spray device 9 and/or of said support 7. Such movement takes place during the spraying, in such a manner as to facilitate covering the entire surface 2 with the decorative material.

Figure 3:
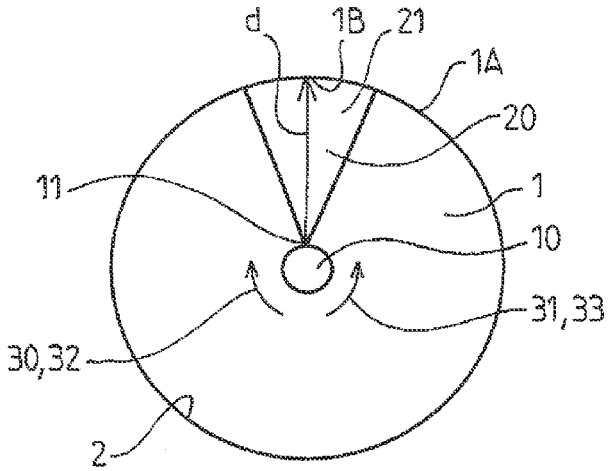
FIG. 3 is a diagrammatic section view from above, showing a narrow spray beam of a spray device of the invention in a bottle that is of substantially circular section.

Said relative movement takes place at a velocity that varies as a function of the distance d between the spray device 9 and said surface 2. The distance d varies as a function of the size and of the shape of the bottle 1. In particular, when said bottle has a section of complex shape, e.g. of rectangular shape, as shown in FIGS. 4 and 5, the distance d is not constant at all points of the bottle 1, as it can be for a bottle 1 of circular section (cf. FIG. 3). The distance d is smaller while the narrow beam 21 is moving along a length L of the section of the bottle 1 than while the narrow beam 21 is moving along a width k of the section of the bottle 1.

The variation in the relative velocity between the support 7 and the spray device 9 makes it possible to mitigate the variations in the distance d, so as to ensure homogeneous and constant distribution of the coating material over the surface 2, which material is, for example, a decorative material.

In particular, the relative velocity increases when the distance d between the spray device 9 and said surface 2 decreases. The closer to the wall 1A, 1B of the bottle 1 the spray nozzle 10 passes, the more the relative velocity should be accelerated in order to avoid having too much decorative material at that place.

The relative velocity decreases when the distance between the spray device and said surface increases. Thus, the further the spray nozzle 10 passes away from the wall 1A, 1B of the bottle 1, the more the relative velocity should be slowed down in order to avoid not having enough decorative material at that place.

Figure 2A:
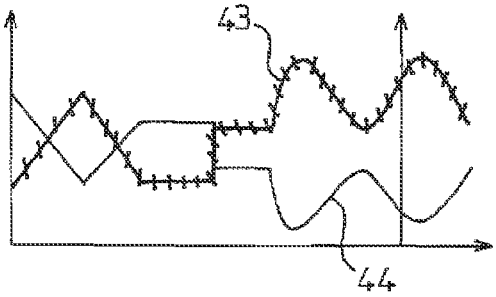
FIG. 2A shows an example of a complex curve representing how the angular velocity of relative movement varies as a function of the distance between the wall of the bottle and the spray device, in accordance with the present invention.
Figure 2B:
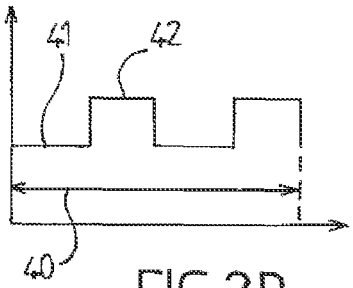
FIG. 2B shows an example of a complex curve representing how the velocity of relative movement varies in accordance with the present invention, in which example the velocity varies stepwise.
Figure 2C:
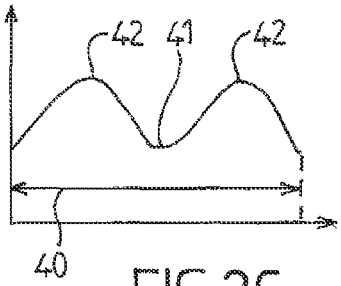
FIG. 2C shows an example of a curve representing how the velocity of relative movement varies in accordance with the present invention, in which example the velocity varies in sinusoidal manner.
Figure 2D:
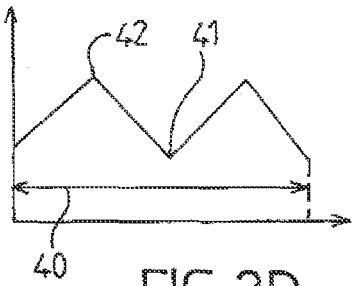
FIG. 2D shows an example of a curve representing how the velocity of relative movement varies in accordance with the present invention, in which example the velocity varies in the form of ramps.

The variation in the velocity may be substantially linear, in such a manner as to correspond, for example, to a ramp or to a curve (cf. FIGS. 2C and 2D). Alternatively, it is also quite possible for the velocity to vary stepwise, as shown in FIG. 2B, or for it to vary in more complex manner, as shown in FIG. 2A by the non-crosshatched curve if the bottle 1 has a particularly complex shape.

Preferably, said relative movement includes rotation of said spray device 9 and/or of said support 7 at an angular velocity that varies. In other words, at least one of the elements constituted by said spray device 9 and by said support 7 is caused to rotate, preferably about a main extension axis (XX') of the bottle 1 in its decoration position.

In a preferred implementation, only the support 7 is caused to rotate, as indicated by one of the arrows 30 and 31, for the purpose of causing the hollow body 1 (e.g. formed by a bottle) to rotate during spraying. Thus, the rotation of the bottle 1 makes it possible for the nozzle 10, which does not rotate, to spray the decorative material over the entire surface 2 of the bottle 1. Causing the support 7 to rotate (from the point of view of a stationary operator), and thus causing the hollow body 1 to rotate, makes it possible, in particular, to avoid necessarily using rotation of the spray device 9, thereby offering various advantages from a practical point of view (e.g., the risk of the air feed duct and of the fluid feed duct becoming entangled is reduced, and it is not necessary to use special connectors for coupling the spray nozzles to the feed ducts) and from a safety point of view (reduced risk of untimely spraying towards the user because it is, for example, possible to direct the spray continuously in a predefined direction compatible with operator safety). In a preferred variant implementation, the hollow body 1 is caused to rotate, preferably about the central axis (XX'), while the spray device 9 is not caused to rotate at all.

However, without going beyond the ambit of the present invention, it is also possible, alternatively, for the nozzle 10 to be caused to rotate about the axis (XX') that substantially coincides with the main extension axis (YY') of said nozzle 10 and as indicated by one of the arrows 32 and 33, either concomitantly with the rotation movement of said support 7, or while said support is not being caused to rotate.

The relative angular velocity is variable as a function of the distance d; it is thus increased when the spray nozzle 10 comes closer to the surface 2 to be decorated and decreased when the spray nozzle 10 comes further away from said surface 2, in order to guarantee the same distribution of the decorative material at all points of the surface 2.

In alternation with or simultaneously with the above-mentioned rotation, said relative movement includes movement in translation of said spray device 9 and/or of said support 7 at a velocity in translation that varies. Preferably, the movement in translation consists of substantially vertical movement, preferably substantially parallel to said extension axes (XX') and/or (YY'), i.e. up-and-down movement of the nozzle 10 relative to said bottle 1, or vice versa.

In a first implementation, only the spray device 9, i.e. only the nozzle 10, is caused to move in vertical translation, as indicated by one of the arrows 34 and 35, e.g. the nozzle 10 is caused to move downwards and/or upwards inside the bottle 1, i.e. in the cavity 5 therein, or outside said bottle, as a function of the fraction of the wall 1A, 1B to be decorated.

In a second implementation, only the support 7 is caused to move in vertical translation, as indicated by one of the arrows 36 and 37, e.g. in a manner such as to enable the bottle 1 to move downwards and/or upwards relative to the nozzle 10, preferably such that the bottle 1 contains said nozzle 10 as shown in FIG. 1.

The velocity in translation is also variable, in particular as a function of the distance d, so that the movement in translation is preferably slowed down when the nozzle 10 comes further away from the surface 2 and so that it is accelerated when the nozzle 10 comes closer to the surface 2.

In other words, the relative movement in rotation and/or the relative movement in translation that is imparted to said support 7 and to said spray device 9 takes place at a velocity that is variable during the spraying as a function of the distance d between the nozzle 10, in particular its spray orifice 11, and the surface 2, in particular the inside wall 1B, of said bottle 1.

It is thus possible for only one of the elements constituted by said support 7 and by said spray device 9 to be caused to move in rotation and/or in translation. It is also quite possible for only one of the velocities constituted by the angular velocity and by the velocity in translation to be variable, while the other velocity is kept constant. At least one of said velocities constituted by the angular velocity and by the velocity in translation preferably varies by following a profile as shown in FIGS. 2A to 2D, or in a combination of said figures.

The various possible adjustment options are as follows:

| | ROTATION | | | TRANSLATION | | |
|---|---|---|---|---|---|---|
| | YES | | | YES | | |
| | Constant velocity | Variable Velocity | NO | Constant velocity | Variable velocity | NO |
| SPRAY DEVICE | x | | | x | | |
| | x | | | | x | |
| | x | | | | | X |
| | | x | | x | | |
| | | x | | | x | |
| | | x | | | | X |
| | | | x | x | | |
| | | | x | | x | |
| | | | x | | | X |
| SUPPORT | x | | | x | | |
| | x | | | | x | |
| | x | | | | | X |
| | | x | | x | | |
| | | x | | | x | |
| | | x | | | | X |

Each option for said spray device 9 can be combined with an option for the support 7, it being understood that, in accordance with the invention, at least one of the elements constituted by said support 7 and by said spray device 9 is caused to move in translation and/or in rotation (rotation always being present for the support 7), and at least one of said velocities constituted by the angular velocity and by the velocity in translation varies.

In a preferred implementation, said relative movement includes a downward movement of said spray device 9 into said hollow body 1 (the bottle 1 in this example), and/or an upward movement of said support 7, in such a manner as to enable at least a fraction of the inside wall 1B of said hollow body 1 (i.e. of the bottle 1) to be coated, and in particular to be decorated. In this implementation, said relative movement preferably includes movement in rotation of said support 7 and movement in translation of said spray device 9 inside said hollow body 1 (the bottle 1 in this example), in such a manner as to enable at least a fraction of the inside wall 1B of said hollow body 1 to be coated, and in particular decorated.

In other words, in this advantageous implementation, the method consists in decorating the inside wall 1B of a perfume bottle 1 made of glass, with, in particular, a sol-gel or a metal solution, sprayed in the form of a spray beam 20 in the shape of a cone that diverges (going from a nozzle 10 towards the inside wall 1B), by a nozzle 10 caused to move up-and-down inside said bottle 1 while said bottle is being caused to rotate about the axis of rotation (XX').

Such a coating method, which is preferably a decoration method, guarantees homogeneous distribution, e.g. in the form of a layer of substantially constant thickness, and preferably of a thin layer when it is a decoration that is not based on a lacquer, and in particular when it is a coating based on metal or obtained by a sol-gel method. This method thus advantageously makes it possible for the coating material, which is, in particular, a decorative material, to be distributed homogeneously with a uniform visual appearance at all points of the surface 2 to be decorated or to be coated, in particular when said surface is constituted by a fraction of the glass inside wall 1B of a bottle 1 of complex shape.

The present invention also relates to a coating machine for coating a surface 2 of an article 1, which coating machine includes a support 7 designed to receive said article 1 and a spray device 9 designed to spray at least one coating material onto said surface 2 of said article 1. Preferably, the coating machine is suitable for implementing the above-described coating method and consists of a coating machine for coating a hollow body 1 as described above.

In a particularly preferred embodiment, the coating machine of the invention constitutes a coating machine for coating at least a fraction of the inside wall 1B of a glass bottle 1, and preferably of a bottle 1 designed to contain a perfumed alcoholic liquid, e.g. a body perfume.

In advantageous manner, it constitutes a decoration machine for decorating said surface 2 with at least one decoration material, and it preferably constitutes a machine for decorating a glass bottle 1, e.g. for decorating at least a fraction of the inside wall 1B of said bottle 1.

Preferably, said machine makes it possible to coat the advantageously glass wall 1A, 1B of a bottle 1 directly in the form of a layer of coating material designed to come directly into contact with the pharmaceutical-type or cosmetic-type contents that are to be contained in said bottle 1.

Said support 7 and said spray device 9 are designed to have relative movement imparted to them, i.e. as explained above, to be moved in rotation and/or in translation relative to each other while the spray device is activated, i.e. while the coating material, which is preferably a decorative material in this example, is being sprayed onto the surface 2. The present invention relates to the relative movement imparted to said support 7 and to said spray device 9 specifically during coating, e.g. decorating, of said bottle 1, it being understood that it is quite possible for the support and for the spray device also to be moved relative to each other before and/or after the decoration step performed by the decoration machine of the invention.

Said coating machine is designed so that said relative movement takes place at a relative velocity that varies as a function of the distance d between said spray device 9 and said surface 2, while the spray device 9 is spraying said at least one coating material.

In order to facilitate understanding, the remainder of the description focuses on describing a preferred embodiment in which the machine of the invention is a decoration machine, it being understood that the data below may be applied to a coating machine in the pharmaceuticals field or in some other field.

Preferably, FIG. 1 shows only a portion of the decoration machine, in which portion the surface 2 is decorated by being sprayed with said decoration material, and said support 7 and said spray device 9 are caused to move relative to each other.

Said support 7 advantageously includes a fitting 7A that is preferably substantially identical to the fitting described in the description above, that has a substantially vertical axis of rotation (XX'), and that is designed to be moved in rotation and/or in translation, as indicated by at least one of the arrows 30, 31, 36, and 37, at a relative velocity that varies.

Advantageously, said spray device 9 includes a spray nozzle 10, e.g. as mentioned above, designed to be moved in rotation and/or in translation, as indicated by at least one of the arrows 32, 33, 34, and 35 at a relative velocity that varies.

As indicated above, the angular velocities and/or the velocities in translation of said support 7 and of said nozzle 10 vary with the distance d, and are preferably increased when the distance d decreases, and decreased when the distance d increases.

Preferably, said spray device 9 sprays said material in the form of a spray beam 20 that is substantially conical in shape, advantageously in the shape of a cone that diverges going away from the nozzle 10, in particular from the spray orifice thereof.

Advantageously, said decoration machine includes servo-control means (not shown) for servo-controlling the relative velocity to said distance d between the spray device 9 and said surface 2. These servo-control means make it possible to cause the angular velocity and/or the velocity in translation of at least one of the elements constituted by said support 7 and by said nozzle 10 to vary as a function of the distance d.

Preferably, said machine includes, in particular, a brushless motor (not shown) designed to adjust the relative velocity while the spray device 9 is spraying said at least one decoration material. The brushless motor makes it possible for the relative movement to be varied with precision as a function of the distance d; it procures servo-control that is fine and optimum in order to adjust the angular velocity and/or the velocity in translation of said support 7 and of said nozzle 10 in appropriate manner, and in order to guarantee homogeneous decoration of the surface 2, regardless of the shape of the bottle 1.

In particular, this brushless motor provides various types of angular velocity profile, e.g. simple profiles of the steps type (cf. FIG. 2B), of the sinusoidal curve type (cf. FIG. 2C), of the ramps type (cf. FIG. 2B), or indeed complex profiles in which at least two of the profiles of FIGS. 2B to 2D (cf. FIG. 2A) are combined. Preferably, the brushless motor thus makes it possible to adapt the velocity of relative movement as appropriately as possible to the distance d, and more generally to the geometrical complexity of the bottle 1 to be decorated.

Alternatively, the motor is a stepper motor that makes it possible solely to achieve one type of variation in the velocity of relative movement, e.g. the type of variation shown in FIG. 2B, or any other type of motor making it possible to vary the velocity of relative movement. Said motor is advantageously mounted on said support 7 and/or on said spray device 9, and is designed to move in rotation and/or in translation at least one of the elements constituted by said support 7 and by said spray device 9.

Preferably, said brushless motor or said stepper motor has at least two velocities, and preferably several velocities, so as to cause said angular velocity and/or said velocity in translation to vary during spraying, following at least one of the velocity profiles shown in FIGS. 2A to 2D that show the variation in the angular velocity of at least one of the elements constituted by said support 7 and by said spray device 9 (plotted up the ordinate axis) as a function of the angle of the bottle 1 to be decorated, i.e. as a function of the shape of said bottle 1 (abscissa axis).

Thus, for example, it is possible, while the bottle 1 is turning through a full turn about the axis (XX'), i.e. a cycle 40 of 360°, for its angular velocity to vary from a low angular velocity 41 while the nozzle 9 is far away from the surface 2 to a high angular velocity 42 while the nozzle 9 is close to the surface 2, in alternation (cf. FIGS. 2B to 2D). Such graphs are naturally transposable with a higher number of angular velocities and during a plurality of cycles 40, depending, for example, on the complexity of the bottle 1, and by use of the servo-control means that make it possible to adapt the angular velocity directly as a function of the distance d.

It is thus quite possible to have an angular velocity profile that varies over a plurality of cycles 40 with a plurality of ramps, of steps, and/or of sinusoidal curves during spraying of the decorative material, so as to match exactly the surface 2 be coated or to be decorated (cf. FIG. 2A). Such a complex velocity profile 43, shown in FIG. 2A by the crosshatched curve, directly matches the variation profile 44 for the distance d shown in the same FIG. 2A by the non-crosshatched curve.

Such a coating machine thus makes it possible to guarantee homogeneous and even distribution of the coating material over the surface 2, in particular when the material is a decorative material, regardless of the size, of the shape, and of the complexity of the bottle 1 to be coated or to be decorated.

The invention claimed is:

1. A coating machine for coating a surface (2) of a hollow body (1) made of glass and constituting a container designed to receive one of food products, pharmaceutical products or cosmetic products, said coating machine including a support (7) designed to receive said hollow body (1) and a spray device (9) designed to spray at least one coating material onto said surface (2) of said hollow body (1), said support (7) and said spray device (9) being designed to have relative movement imparted to them, said coating machine being characterized in that it is designed so that said relative movement includes rotation of said support (7) taking place at a velocity that varies as a function of the distance (d) between said spray device (9) and said surface (2), while the spray device (9) is spraying said at least one coating material.

2. A coating machine according to claim 1, characterized in that it includes servo-control means for servo-controlling the relative velocity to said distance (d) between the spray device (9) and said surface (2).

3. A coating machine according to claim 1, characterized in that it includes a brushless motor designed to adjust the relative velocity while the spray device (9) is spraying said at least one coating material.

4. A coating machine according to claim 3, characterized in that said motor is mounted on said support (7) and/or on said spray device (9), and is designed to move in rotation and/or in translation at least one of the elements constituted by said support (7) and by said spray device (9).

5. A coating machine according to claim 1, characterized in that said spray device (9) includes a spray nozzle (10) designed to be moved in rotation and/or in translation at a relative velocity that varies.

6. A coating machine according to claim 1, characterized in that said support (7) includes a fitting (7A) having an axis of rotation (XX') that is substantially vertical, and designed to be moved in rotation and/or in translation at a relative velocity that varies.

7. A coating machine according to claim 1, characterized in that said spray device (9) sprays said material to the form of a spray beam (20) that is substantially conical in shape.

8. A coating machine according to claim 1, characterized in that it constitutes a coating machine for coating at least a fraction of the inside wall (1B) of a glass bottle (1).

9. A coating machine according to claim 1, characterized in that it constitutes a machine for decorating said surface (2) with at least one decoration material.

10. A coating machine according to claim 9 characterized in that it constitutes a machine for decorating a glass bottle (1).

11. A method of coating a surface (2) of a hollow body (1) made of glass and constituting a container designed to receive one of food products, pharmaceutical products or cosmetic products, said method comprising:

a step of positioning said hollow body (1) on a support (7) designed to receive said hollow body (1); and a step of spraying at least one coating material onto said surface (2) of said hollow body (1) by means of a spray device (9), relative movement being imparted to said support (7) and to said spray device (9);

said coating method being characterized in that said relative movement includes rotation of said support (7) taking place at a velocity that varies as a function of the distance (d) between the spray device (9) and said surface (2).

12. A coating method according to claim 11, characterized in that said velocity increases when the distance (2) between the spray device (9) and said surface (2) decreases.

13. A coating method according to claim 11, characterized in that said velocity decreases when the distance (2) between the spray device (9) and said surface (2) increases.

14. A coating method according claim 11, characterized in that said relative movement includes rotation of said spray device (9).

15. A coating method according to claim 11, characterized in that said relative movement includes movement in translation of said spray device (9) and/or of said support (7) at a velocity in translation that varies.

16. A coating method according to claim 11, characterized in that, during the spraying step, said coating material is sprayed in the form of a spray beam (20) that is substantially conical in shape.

17. A coating method according to claim 11, characterized in that said relative movement includes a downward movement of said spray device (9) into said hollow body (1) and/or an upward movement of said support (7), in such a manner as to enable at least a fraction of the inside wall (1B) of said hollow body (1) to be coated.

18. A coating method according to claim 11, characterized in that said relative movement includes movement in rotation of said support (7) and movement in translation of said spray device (9) inside said hollow body (1), in a manner such as to enable at least a fraction of the inside wall (1B) of said hollow body (1) to be coated.

19. A coating method according to claim 11, characterized in that said at least one coating material is chosen from among at least one of the following coating materials: lacquer, sol-gel solution, metal solution, solutions constituted by organometallic resins, varnish, and paint.

20. A coating method according to claim 11, characterized in that said hollow body (1) is a bottle (1).

21. A coating method according to claim 20, characterized in that said bottle (1) is designed to contain a pharmaceutical, a care cosmetic, or a perfume.

22. A coating method according to claim 11, characterized in that said hollow body (1) is a glass bottle (1).

23. A coating method according to claim 11, characterized in that the method is performed to decorate said surface (2) with at least one decoration material.

24. A coating method according to claim 23, characterized in that the method is performed to decorate a glass bottle (1).

* * * * *